US007849962B2

(12) United States Patent
Barbara

(10) Patent No.: US 7,849,962 B2
(45) **Date of Patent: *Dec. 14, 2010**

(54) PORTABLE RAILCAR STEP AND RAILCAR THEREWITH

(75) Inventor: Jonathan A. Barbara, Toledo, OH (US)

(73) Assignee: Coug Enterprises, Inc., Blacklick, OH (US)

( * ) Notice: Subject to any disclaimer, the term of this patent is extended or adjusted under 35 U.S.C. 154(b) by 783 days.

This patent is subject to a terminal disclaimer.

(21) Appl. No.: 11/520,536

(22) Filed: Sep. 13, 2006

(65) Prior Publication Data

US 2008/0060875 A1 Mar. 13, 2008

(51) Int. Cl.
*B61D 23/00* (2006.01)

(52) U.S. Cl. ..... 182/127; 182/90; 182/92; 105/443; 248/205.1; 280/163

(58) Field of Classification Search ..... 182/127, 182/92, 90, 5.57, 60; 280/163, 164.1, 164.2, 280/166, 169; 248/208, 210, 211, 238; 105/461, 105/460, 443, 449, 355; 108/157.1, 157.13, 108/154, 57.21, 26; 269/87.2, 95, 87.1
See application file for complete search history.

(56) References Cited

U.S. PATENT DOCUMENTS 714,753 A * 12/1902 Siteman ..... 182/99
1,061,100 A * 5/1913 Mitchell ..... 182/99
1,829,324 A * 10/1931 Aland et al. ..... 182/58
2,153,945 A * 4/1939 Thelander ..... 182/88
2,833,608 A * 5/1958 Tobias ..... 108/44
3,891,053 A * 6/1975 Burton ..... 182/97
H421 H * 2/1988 Glommen ..... 280/169
4,869,520 A * 9/1989 Cole ..... 280/164.1
4,911,264 A 3/1990 McCafferty
5,007,654 A * 4/1991 Sauber ..... 280/166
5,139,295 A 8/1992 Escobedo
5,386,784 A * 2/1995 Meier ..... 105/461
5,734,191 A 3/1998 Chi et al.
5,743,191 A 4/1998 Coslovi
5,931,257 A * 8/1999 Harden ..... 182/92
7,401,560 B2 * 7/2008 McCrary ..... 105/457
2006/0260504 A1 * 11/2006 McCrary ..... 105/443

* cited by examiner

*Primary Examiner*—Katherine Mitchell
*Assistant Examiner*—Daniel Cahn
(74) *Attorney, Agent, or Firm*—Goodman, Allen & Filetti PLLC

(57) ABSTRACT

A rail vehicle step mounts to the sill step of a rail vehicle. The rail vehicle step comprises a support sized to support a rail worker. A coupling is supported in relation to an end of the support. The coupling is sized and configured to hold the support in fixed relation to the sill step. The support is sized to extend outward beyond the rail vehicle and support a rail worker.

13 Claims, 4 Drawing Sheets

PORTABLE RAILCAR STEP AND RAILCAR THEREWITH

BACKGROUND OF INVENTION

The present invention relates generally to land vehicles and, more particularly, to steps for land vehicles. Alternatively, the invention relates to railway vehicles and steps for railway vehicles.

A railcar is a railway vehicle that is adapted to travel on the rails of a railway and is largely used for hauling. Railcars are typically coupled together to form a train and are hauled by a locomotive. A ladder is, or handholds 18 in a ladder rung arrangement are, mounted on the sides of the railcar and near each corner, as illustrated in FIG. 1. A sill step 20 is mounted to each corner of the railcar to provide a foot step at a height between the lowest handhold and the ground. The sill step 20 is typically in the form of a U-shaped structure formed from substantially flat metal stock and having a lower step member and a leg extending upwardly from opposing ends of the step member. The handholds 18 are provided for an operator to grip while ascending or descending the sill step 20. A rail worker may stand on the sill step 20 and hold onto a handhold 18 as the railcar is transported around a rail yard. The sill step 20 is mounted inward of the railcar. Consequently, the rail worker must lean outward at an angle.

SUMMARY OF INVENTION

The present invention is directed toward a rail vehicle step for mounting to the sill step of a rail vehicle. The rail vehicle step comprises a support sized to support a rail worker. A coupling is supported in relation to an end of the support. The coupling is sized and configured to hold the support in fixed relation to the sill step. The support is sized to extend outward beyond the rail vehicle and support a rail worker.

DETAILED DESCRIPTION

Figure 1:
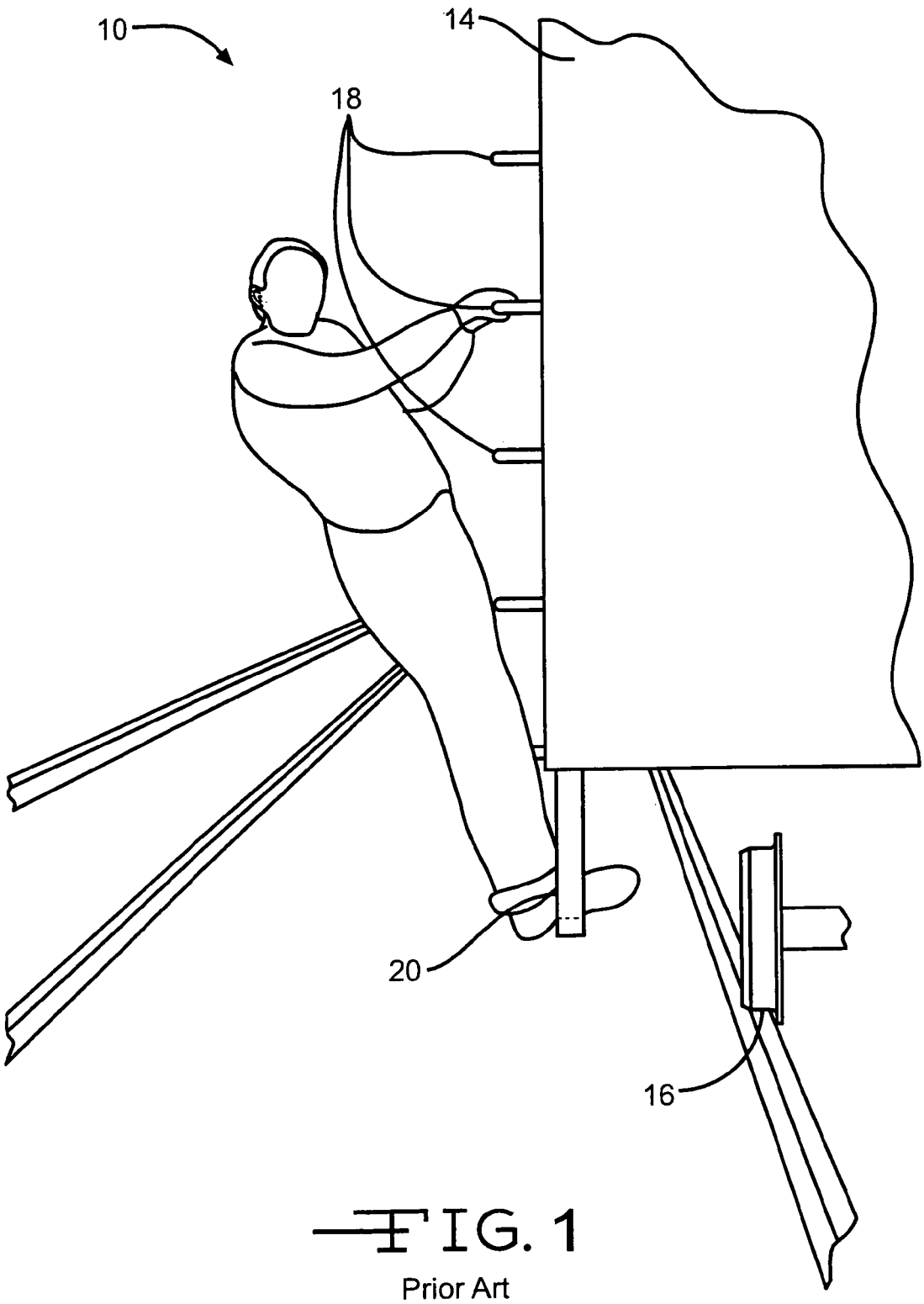
FIG. 1 Prior Art
FIG. 1 is a partial environmental rear elevational view of a prior art rail vehicle step.
Figure 2:
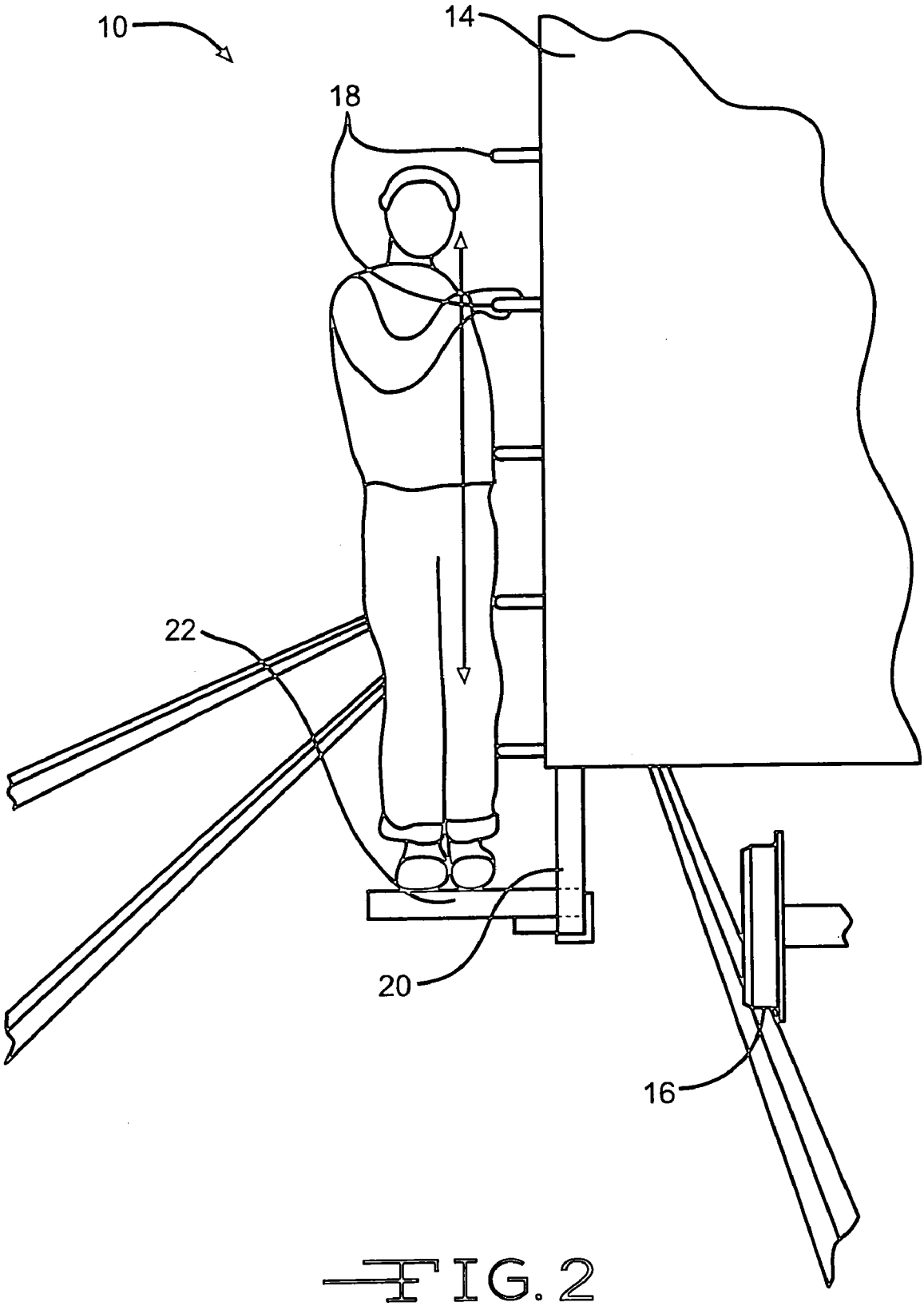
FIG. 2 is a partial environmental rear elevational view of a rail vehicle step according to one embodiment of the invention.

Referring now to the drawings, there is illustrated in FIG. 2 a rail vehicle 10 having a body 14 and wheels 16 for supporting the vehicle 10 for movement along rails. A ladder is, or handholds 18 in a ladder rung arrangement are, mounted in a ladder rung arrangement on the side of the body 14 near a corner of the body 12. A sill step 20 is mounted to the corner of the vehicle 10 just beneath the body 12, and inward of the handholds 18. A rail vehicle step 22 is mounted to the sill step 20. The rail vehicle step 22 is sized to extend outward beyond the side of the body 14 so that rail worker may stand on the rail vehicle step 22 and hold onto a handhold 18 without leaning outward at a substantial angle, as is required without the rail vehicle step 22.

Figure 3:
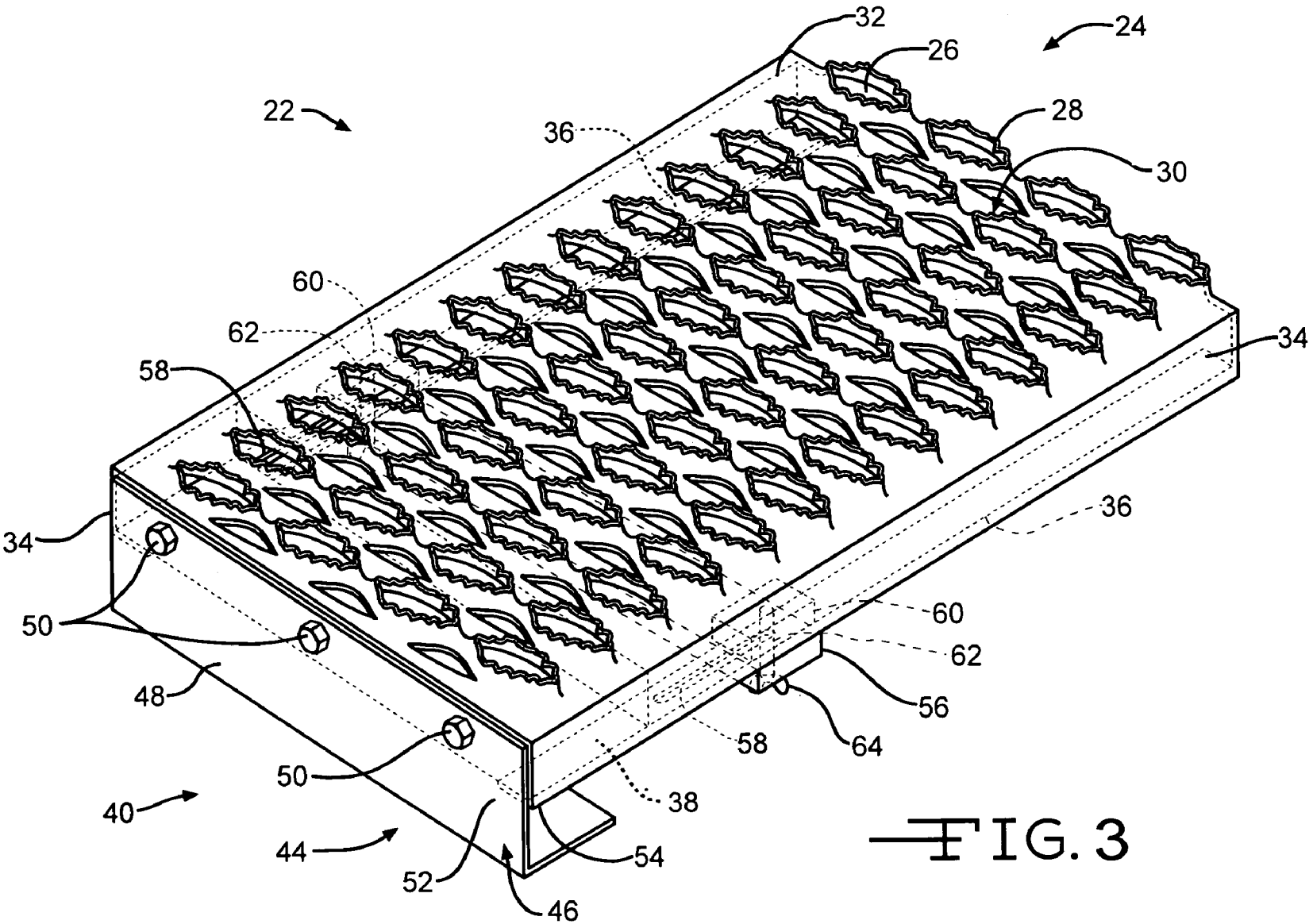
FIG. 3 is an enlarged front perspective view of the rail vehicle step shown in FIG. 2.

As shown in FIG. 3, the rail vehicle step 22 comprises a support, such as a plank grating 24, such as the GRIP STRUT® plank grating manufactured by McNichols of Atlanta, Ga., U.S.A. Such a plank grating 24 has diamond-shaped openings 26 with serrated teeth 28 providing a safe, slip resistant surface, generally indicated at 30, that grabs in all or nearly all directions. The surface 30 is ideally suited for most if not all inside and outside conditions—and is resistant to effects or collection of grease, snow, mud, ice, detergent, etc. The openings 26 are small enough to catch most falling items, such as tools. The plank grating 24 also has a high load capacity and a long life.

Although the general shape of the plank grating 24 may take other forms, the illustrated plank grating 24 has an inverted generally U-shaped cross-section that comprises a top 32 and opposing sides 34 with inwardly rolled lips 36 along the bottom of both sides 34. The plank grating 24 should be sufficiently wide to provide ample support for a rail worker and sufficiently long to extend beyond the side of the rail vehicle body 14. For example, a plank grating that is about 9 inches (22.86 cm) wide and 16 inches (40.64 cm).

The plank grating 24 is preferably aluminum, galvanized, stainless steel, plain steel, or a combination thereof, although other plank gratings, including but not limited to those formed of composite materials, may be suitable for carrying out the invention. The thickness of the plank grating 24 may be dependent on the material from which the plank grating 24 is formed, but for the metals described above, the plank grating 24 may be about a 12-16 gauge plank grating.

It should be appreciated that the plank grating 24 shown and described above is merely exemplary support and that other supports may be suitable for carrying out the invention.

Figure 4:
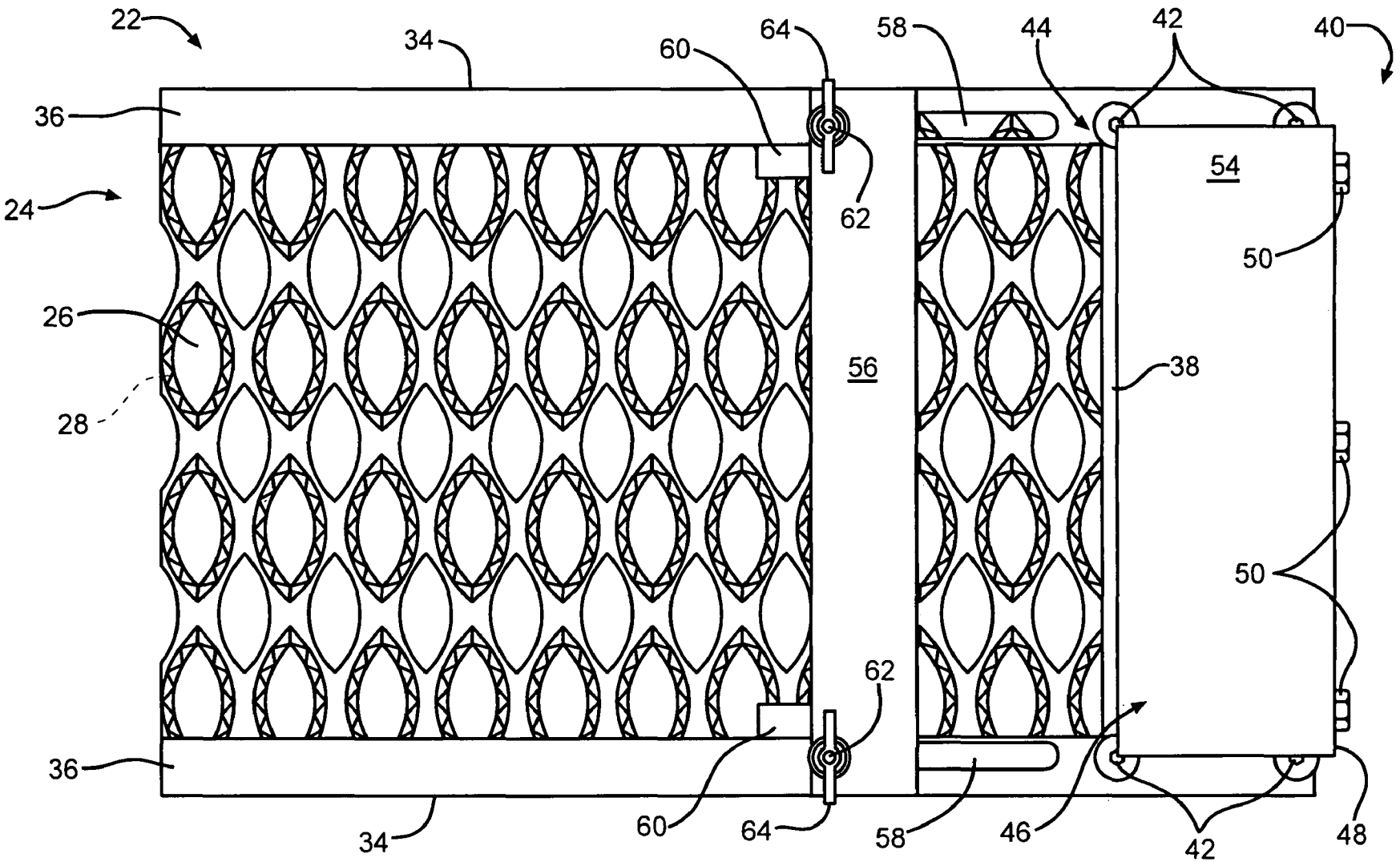
FIG. 4 is an enlarged bottom plan view of the rail vehicle step shown in FIG. 3.

A block of material 38 is inserted in one end, generally indicated at 40, of the plank grating 24, so as to be captured by the inverted generally U-shaped cross-section (i.e., within the top 32, opposing sides 34 and inwardly rolled lips 36). The block of material 38 is mounted to the inwardly rolled lips 36 of the plank grating 24, such as by threaded fasteners 42, as shown in FIG. 4, that pass through holes (not shown) in the inwardly rolled lips 36 and thread into threaded holes (not shown) in an underside of the block of material 38. The block of material 38 and the manner in which it is attached are merely provided as an example of an embodiment for mounting a hook 44 to the end 40 of the plank grating 24.

The hook 44 is formed at least in part by an L-shaped member, generally indicated at 46. A first leg 48 of the L-shaped member 46 is mounted to the block of material 38, such as by threaded fasteners 50 that pass through holes (not shown) in the first leg 48 and thread into threaded holes (not shown) in an exposed side 52 of the block of material 38. A second leg 54 of the L-shaped member 46 extends beneath the end 40 of the plank grating 24, in spaced relation to the bottom of the plank grating 24. The spaced relation provides sufficient space between the plank grating 24 and the second leg 54 of the L-shaped member 46 to receive the rail vehicle sill step 20 therebetween. The space preferably permits ease of placement of the still step 20 in the space yet hold the still step 20 substantially secure therein. It should be appreciated that the hook 44 may take on other shapes and may be mounted to the plank grating 24 in any suitable manner, such as by welding or otherwise to the block of material 38 or directly to the end 40 of the plank grating 24, in which case it may be possible to omit the block of material 38.

It is contemplated that the still step 20 be retained in the space described above to hold the plank grating 24 in a substantially fixed relation to the sill step 20. This may be accomplished in any suitable manner. For example, a retainer, such as a bar 56, may be supported for movement in relation to the plank grating 24. The illustrated bar 56 extends in the width direction of the plank grating 24, substantially parallel to the hook 44.

The bar 56 may be mounted in sliding relation to the inwardly rolled lips 36 along the bottom of both sides 34 of the plank grating 24. This may be accomplished, for example, by providing slots 58 in the inwardly rolled lips 36 that extend lengthwise of the plank grating 24. Sliding blocks 60 may be provided above the inwardly rolled lips 36 and threaded fasteners 62, preferably held in fixed relation to the sliding blocks 60, may extend from the sliding blocks 60 through the slots 58 and further through holes (not shown) in the bar 56. Wing nuts 64, or other suitable mating fasteners, may be tightened onto the threaded fasteners 62 to retain the bar 56 in sliding relation to the plank grating 24 and further tightened to hold the bar 56 in a fixed relation to the plank grating 24 and in close proximity to the hook 40 to retain the sill step 20.

It should be appreciated that the invention is not intended to be limited to the sliding bar 56 and the manner in which the bar 56 is supported in relation to the plank grating 24 that are shown and described, and that other forms of retainers may be suitable for carrying out the invention.

In operation, the plank grating 24 is removably coupled to the sill step 20 by hooking the hook 44 inwardly behind and beneath the sill step 20 with the plank grating 24 extending over the sill step 20 and outward beyond the side of the body 14. With the wing nuts 64 loosened, the bar 56 is slid in relation to the plank grating 24 in close proximity to the hook 40 to trap the sill step 20 thereby. Then, the wing nuts 64 are tightened to hold the bar 56 in a fixed relation to the plank grating 24 and retain the sill step 20. Accordingly, the plank grating 24 may support a rail worker, as shown in FIG. 2, so that rail worker may stand on the rail vehicle step 22 and hold onto a handhold 18 without leaning outward at a substantial angle.

The plank grating 24 may be removed simply by loosening the wing nuts 64, sliding the bar 56 away from the hook 44 to permit removal of the sill step 20, and then by unhooking the rail vehicle step 22.

The rail vehicle step 22 is easily removed, and is sized and sufficiently lightweight to permit the rail vehicle step 22 to be easily transported.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A rail vehicle step for releasably mounting to a sill step of a rail vehicle, the rail vehicle comprising a body, wheels for supporting the body for movement along rails, and a ladder rung arrangement mounted on the body, the sill step mounted beneath the body, inward of the ladder rung arrangement, the rail vehicle step comprising:

a plank grating having a width and a length, the length dimensioned so that the plank grating extends outward beyond the side of the body of the rail vehicle so that a rail worker can stand on the plank grating and hold onto the ladder rung configuration, the plank grating having a bottom and comprising an inverted generally U-shaped cross-section comprising a top and opposing sides, each of the sides having a bottom and an inwardly rolled lip along the bottom of each of the sides, a block of material extending in the width direction of the plank grating and inserted in one end of the plank grating, within the top, the opposing sides and the inwardly rolled lips thereof, the block of material mounted to the inwardly rolled lips of the plank grating, a hook mounted to the block of material at an end of the plank grating, the hook comprising an L-shaped member having a first leg mounted to the block of material and a second leg extending beneath the end of the plank grating, in spaced relation to the bottom of the plank grating in order to provide space between the plank grating and the second leg to receive the rail vehicle sill step therebetween, a bar extending in the width direction of the plank grating, substantially parallel to the hook, the bar mounted in sliding relation to the inwardly rolled lips along the bottom of both of the sides of the plank grating, and one or more fasteners for releasably holding the bar in fixed relation to the plank grating and in close proximity to the hook to retain the sill step in the hook, and wherein each of the inwardly rolled lips have slots therein that extend the length direction of the plank grating, the bar mounted in relation to sliding blocks provided above each of the inwardly rolled lips by the fasteners, the fasteners extend from the sliding blocks through the slots and further through holes in the bar, wherein the fasteners are threaded and the bar is releasably held in fixed relation to the plank grating by wing nuts that are tightened onto the threaded fasteners.

2. The rail vehicle step of claim 1 wherein the plank grating has diamond-shaped openings with serrated teeth.

3. The rail vehicle step of claim 1 wherein the plank grating is about 9 inches wide and about 16 inches long.

4. The rail vehicle step of claim 1 wherein the plank grating is aluminum, galvanized, stainless steel, plain steel, or a combination thereof.

5. The rail vehicle step of claim 1 wherein the plank grating is about a 12-16 gauge plank grating.

6. The rail vehicle step of claim 1, wherein the hook is formed at least in part by an L-shaped member.

7. A rail vehicle comprising:

a body, wheels for supporting the body for movement along rails, a ladder rung arrangement mounted on the body, a sill step is mounted beneath the body, inward of the ladder rung arrangement, and a rail vehicle step is releasably mounted to the sill step, the rail vehicle step comprising:

a plank grating having a width and a length, the length dimensioned so that the plank grating extends outward beyond the side of the body so that a rail worker can stand on the rail vehicle step and hold onto the ladder rung arrangement without leaning outward at a substantial angle in relation to the body, the plank grating having a bottom and comprising an inverted generally U-shaped cross-section comprising a top and opposing sides, each of the sides having a bottom and an inwardly rolled lip along the bottom of each of the sides, a block of material extending in a width direction of the plank grating and inserted in one end of the plank grating, within the top, the opposing sides and the inwardly rolled lips thereof, the block of material mounted to the inwardly rolled lips of the plank grating, a hook mounted to the block of material at an end of the plank grating, the hook comprising an L-shaped member having a first leg mounted to the block of material and a second leg extending beneath the end of the plank grating, in spaced relation to the bottom of the plank grating to provide space between the plank grating and the second leg to receive the rail vehicle sill step therebetween, a bar extending in the width direction of the plank grating, substantially parallel to the hook, the bar mounted in sliding relation to the inwardly rolled lips along the bottom of both of the sides of the plank grating, and one or more fasteners for releasably holding the bar in fixed relation to the plank grating and in close proximity to the hook to retain the sill step in the hook.

8. The rail vehicle of claim 7 wherein the plank grating has diamond-shaped openings with serrated teeth.

9. The rail vehicle of claim 7 wherein the plank grating is about 9 inches wide and about 16 inches long.

10. The rail vehicle of claim 7 wherein the plank grating is aluminum, galvanized, stainless steel, plain steel, or a combination thereof.

11. The rail vehicle of claim 7 wherein the plank grating is about a 12-16 gauge plank grating.

12. The rail vehicle of claim 7, wherein the hook is formed at least in part by an L-shaped member.

13. The rail vehicle of claim 7 wherein the inwardly rolled lips have slots therein that extend the length direction of the plank grating, the bar mounted in relation to sliding blocks provided above the inwardly rolled lips by the fasteners that extend from the sliding blocks through the slots and further through holes in the bar, wherein the fasteners are threaded and the bar is releasably held in fixed relation to the plank grating by wing nuts that are tightened onto the threaded fasteners.

* * * * *